US007517261B2

(12) United States Patent
Wan et al.

(10) Patent No.: US 7,517,261 B2
(45) Date of Patent: Apr. 14, 2009

(54) BATTERY CONNECTOR

(75) Inventors: Wei Wan, Hsin-Tien (TW); Shu-Lin Duan, Hsin-Tien (TW)

(73) Assignee: Advanced Connectek Inc. (TW)

( * ) Notice: Subject to any disclaimer, the term of this patent is extended or adjusted under 35 U.S.C. 154(b) by 0 days.

(21) Appl. No.: 12/105,216

(22) Filed: Apr. 17, 2008

(65) Prior Publication Data

US 2008/0268712 A1 Oct. 30, 2008

(30) Foreign Application Priority Data

Apr. 27, 2007 (TW) ..... 96206789 U

(51) Int. Cl.
*H01R 4/48* (2006.01)

(52) U.S. Cl. ..... 439/862

(58) Field of Classification Search ..... 439/862, 439/627, 500, 660, 626, 167
See application file for complete search history.

(56) References Cited

U.S. PATENT DOCUMENTS 6,315,621 B1 11/2001 Natori et al.
6,540,567 B1 4/2003 Yeh
6,702,621 B2 * 3/2004 Yeh ..... 439/660
6,851,986 B2 * 2/2005 Zhao ..... 439/744
7,122,274 B2 * 10/2006 Oe et al. ..... 429/123
7,278,892 B1 * 10/2007 Chien et al. ..... 439/862
7,387,541 B1 * 6/2008 Lai et al. ..... 439/660
2003/0216067 A1 * 11/2003 Yeh ..... 439/83
2004/0121654 A1 * 6/2004 Chao et al. ..... 439/660
2006/0128229 A1 * 6/2006 Peng et al. ..... 439/682
2007/0232102 A1 * 10/2007 Huang et al. ..... 439/166

* cited by examiner

*Primary Examiner*—Alexander Gilman
(74) *Attorney, Agent, or Firm*—Hershkovitz & Associates, LLC; Abraham Hershkovitz

(57) ABSTRACT

A battery connector has an insulative housing and a plurality of terminals. The insulative housing has a lateral segment and an upright segment. The lateral segment has a plurality of through holes. The upright segment has a plurality of open slots. The terminals are mounted on the insulative housing and each terminal has a circular cross section, a mounting section, a resilient section and a contacting section. The mounting section is mounted in one through hole. The contacting section is mounted on one open slot. The terminals made by a bending process increases the production rate and lowers the manufacturing cost of the battery connector.

8 Claims, 5 Drawing Sheets

BATTERY CONNECTOR

BACKGROUND OF THE INVENTION

1. Field of the Invention

The present invention relates to a connector, and more particularly to a battery connector that has an insulative housing and multiple terminals mounted securely on the insulative housing.

2. Description of Related Art

With reference to FIG. 1, U.S. Pat. No. 6,540,567 discloses a battery connector having an insulative housing (1), a terminal set (2) and a mounting bracket (20). The insulative housing (1) has an open bottom and multiple passageways defined through the insulative housing (1). The terminal set (2) has a plurality of terminals (21) mounted respectively through the passageways in the insulative housing (1). The mounting bracket (20) is mounted on the open bottom of the insulative housing (1) and holds the terminals (21). However, the battery connector is manufactured imprecisely by a stamping process, which makes the fabrication of the battery connector fail easily and therefore lowers the production rate of the battery connector. Furthermore, limited by the stamping process, reducing sizes of the terminals is difficult, which causes the battery connector to be incompact and has a considerable size.

With reference to FIG. 2, U.S. Pat. No. 6,315,621 discloses one terminal of a conventional battery connector. The terminal is a mounting portion (5), a resilient arm portion (4) and a contacting portion (3). The mounting portion (5) is mounted in an insulative housing of the battery connector. The resilient arm portion (4) protrudes from the mounting portion (5). The contacting portion (3) protrudes from the resilient arm portion (5). However, the terminal is shaped complicated and manufactured imprecisely by a stamping process so that the terminal does not match the insulative housing very well, which causes inadvertent deformation or breaks of the terminal.

To overcome the shortcomings, the present invention provides a battery connector to mitigate or obviate the aforementioned problems.

SUMMARY OF THE INVENTION

The main objective of the invention is to provide a battery connector that has an insulative housing and multiple terminals mounted securely on the insulative housing.

A battery connector has an insulative housing and a plurality of terminals. The insulative housing has a lateral segment and an upright segment. The lateral segment has a plurality of through holes. The upright segment has a plurality of open slots. The terminals are mounted on the insulative housing and each terminal has a circular cross section, a mounting section, a resilient section and a contacting section. The mounting section is mounted in one through hole. The contacting section is mounted on one open slot. The terminals made by a bending process increases the production rate and lowers the manufacturing cost of the battery connector.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
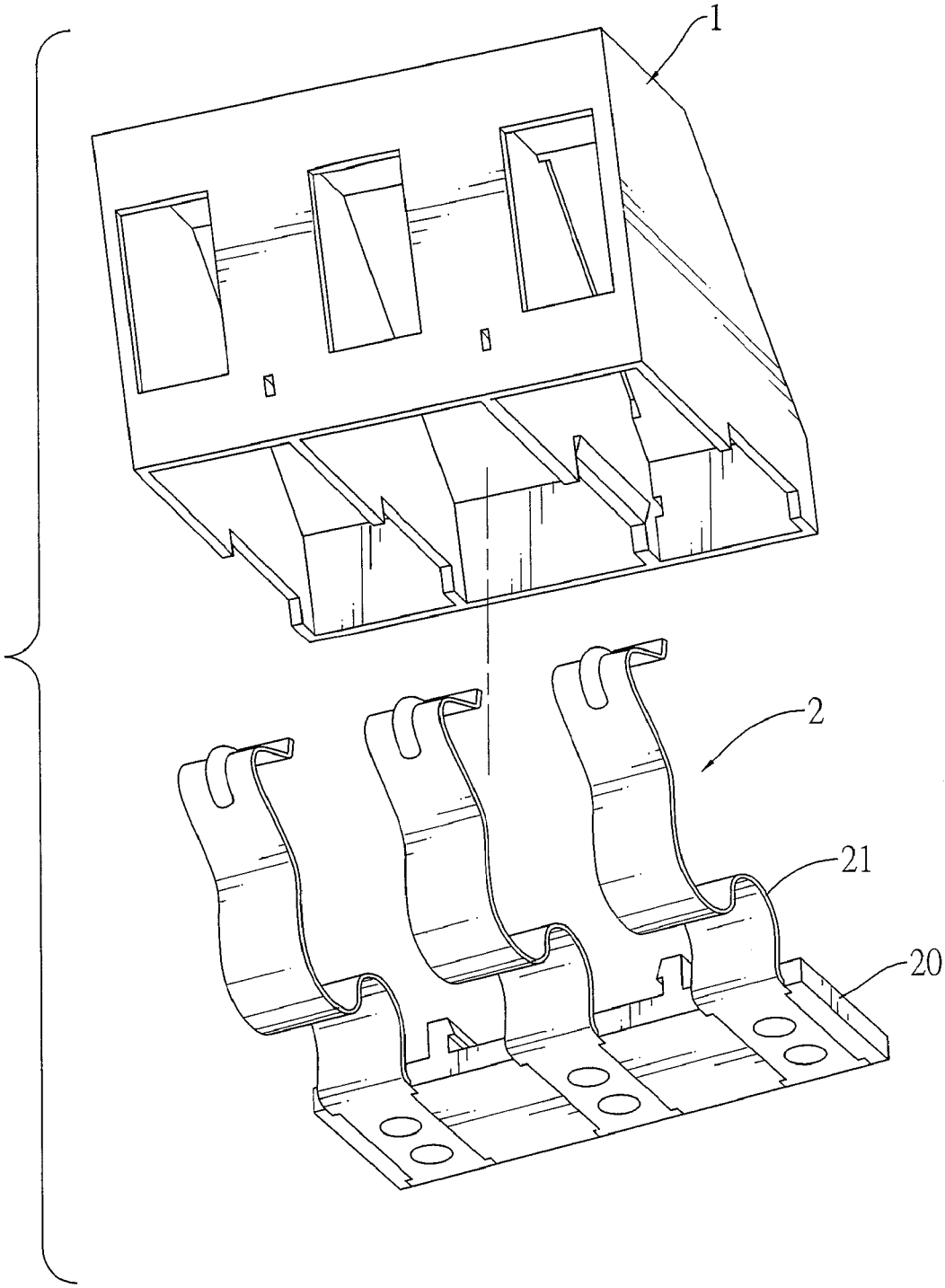
FIG.1 PRIOR ART
FIG. 1 is an exploded perspective view of a conventional battery connector in accordance with the prior art.
Figure 2:
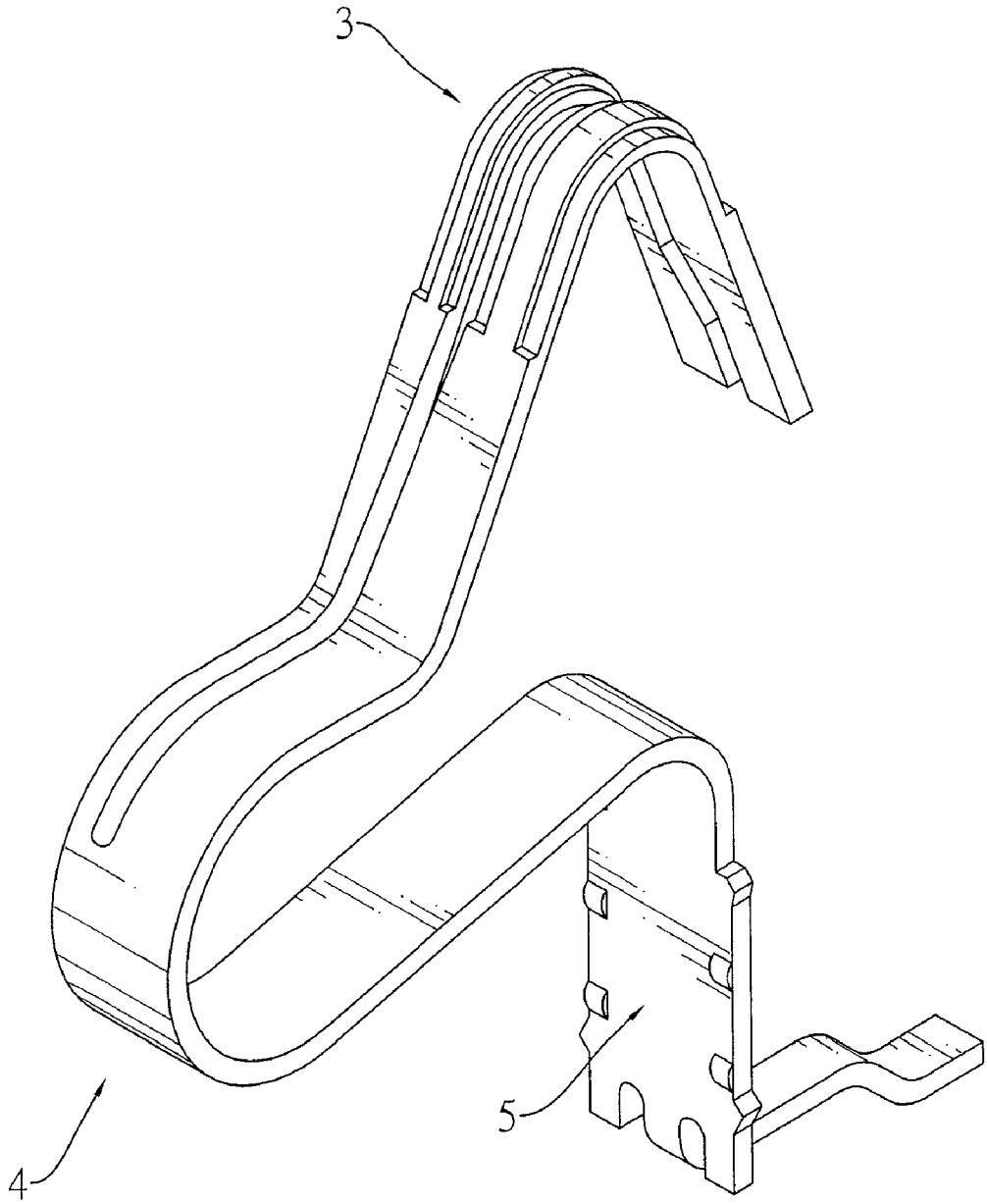
FIG.2 PRIOR ART
FIG. 2 is a perspective view of a conventional terminal of a battery connector in accordance with the prior art.
Figure 3:
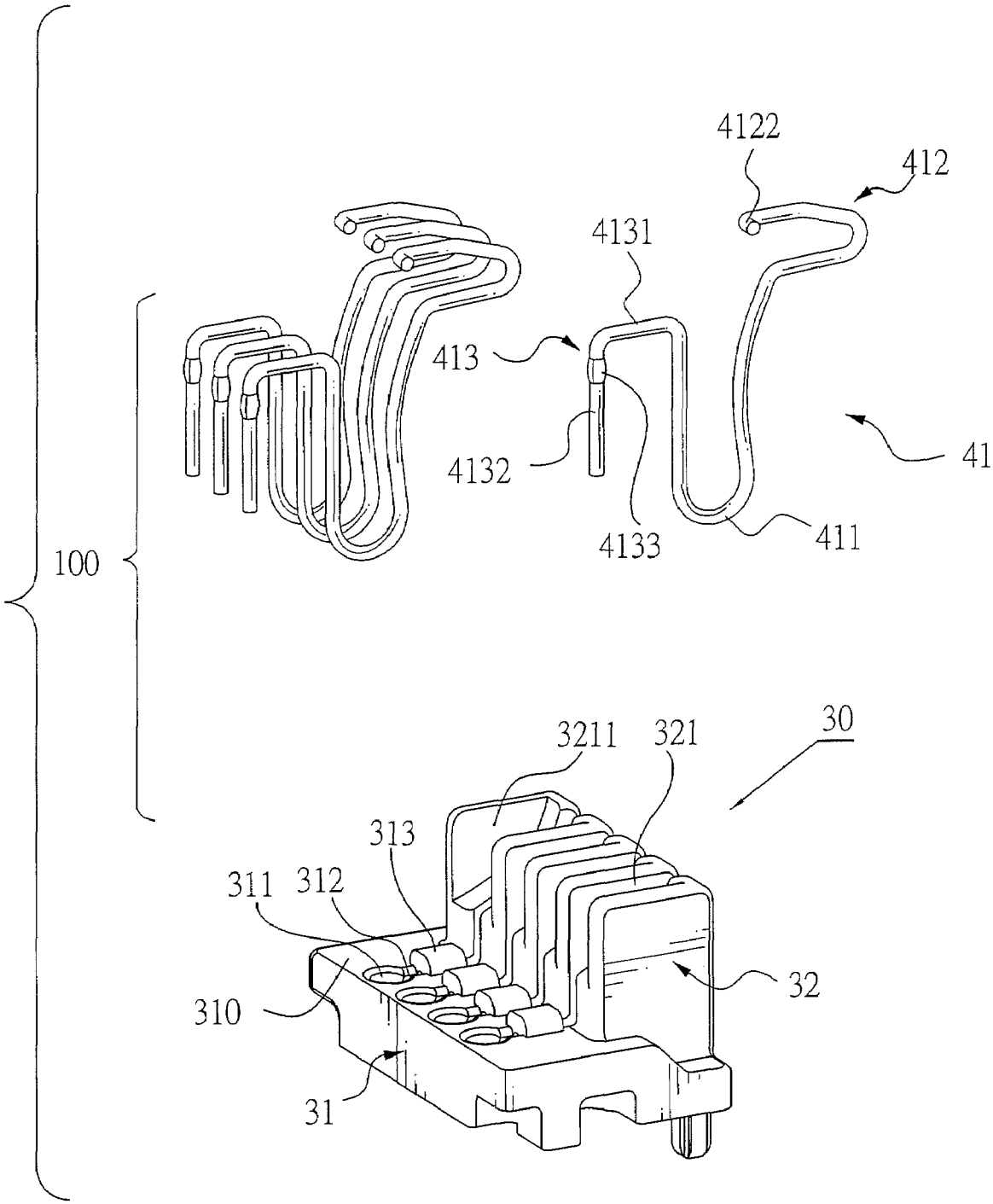
FIG. 3 is an exploded perspective view of a battery connector in accordance with the present invention.
Figure 4A:
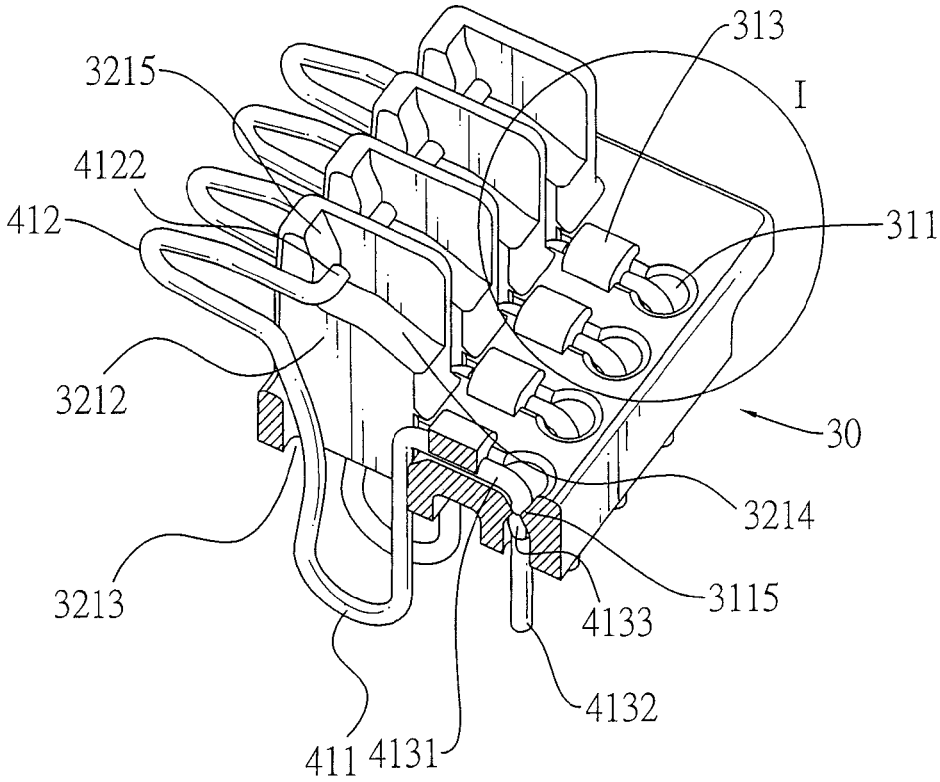
FIG. 4*a* is a cross sectional perspective view of the battery connector in FIG. 3.
Figure 4B:
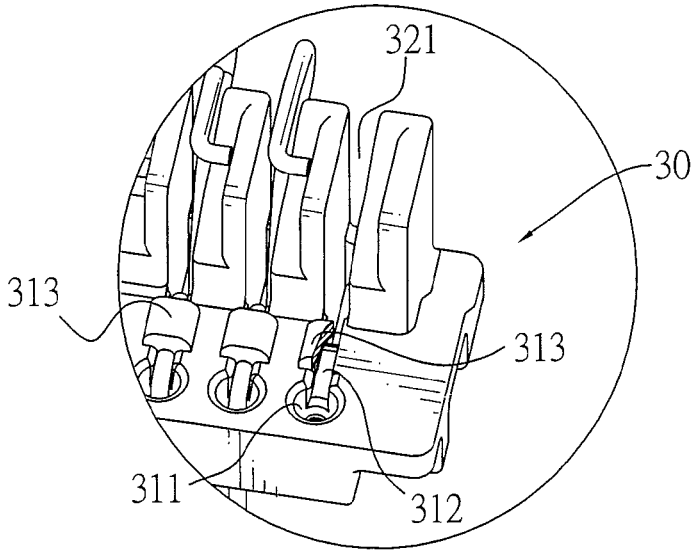
FIG. 4*b* is an enlarged perspective view in partial section of the battery connector in the I section of FIG. 4*a;*

With reference to FIGS. 3, 4*a* and 4*b*, a battery connector (100) in accordance with the present invention comprises an insulative housing (30) and a plurality of terminals (41).

Figure 5:
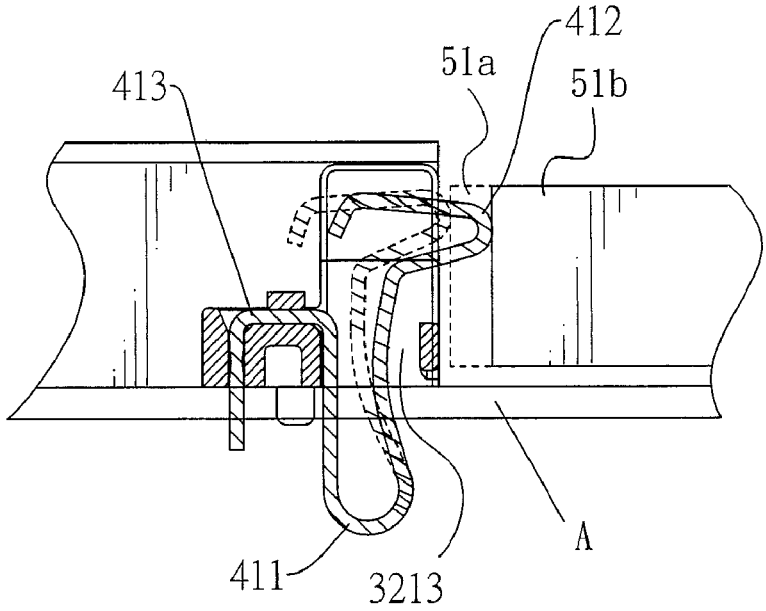
FIG. 5 is an operational side view in partial section of the battery connector mounted on a printed circuit board and connected to a battery.

With further reference to FIG. 5, the insulative housing (30) is mounted on a printed circuit board (A), may be made of plastic and has a lateral segment (31) and an upright segment (32).

Figure 6:
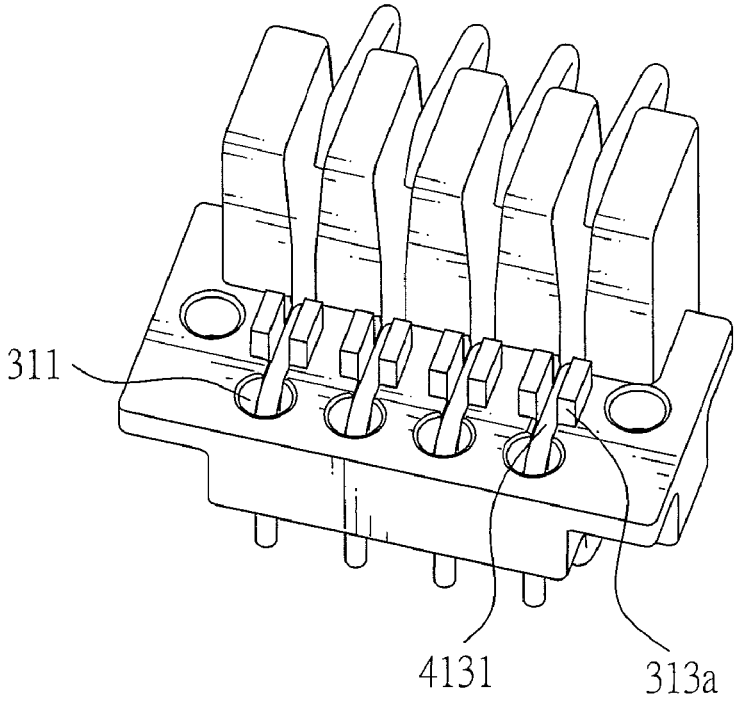
FIG. 6 is a perspective view of a semi-product of the battery connector in FIG. 3.

With further reference to FIG. 6, the lateral segment (31) has a top (310), a bottom, a front end, a rear end, a row of through holes (311), a row of positioning passageways (312) and a row of limiting blocks (313). The through holes (311) are defined uprightly through the lateral segment (31) from the top (310) to the bottom and each through hole (311) may have a narrowed section (3115). The narrowed section (3115) is formed near the top (310) of the lateral segment (31). The positioning passageways (312) correspond respectively to the through holes (311), are defined through the lateral segment (31) from the top (310) to the bottom, communicate respectively with the through holes (311) and each positioning passageway (312) has two opposite sides. The limiting blocks (313) correspond respectively to the positioning passageways (312), are formed on the top (310) of the lateral segment (31) and cross respectively over the positioning passageways (312). Each limiting block (313) may be formed from two protrusions (313*a*) formed on and protruding from the top (310) of the lateral segment (31) adjacent respectively to the sides of a corresponding positioning passageway (312). The protrusions (313*a*) are heated, melted and merged together to form the limiting block (313), as shown in FIG. 6.

The upright segment (32) is formed on and protrudes uprightly from the top (310) of the lateral segment (31) near the front end and has a row of open slots (321). The open slots (321) are defined through the upright segment (32), communicate respectively with the positioning passageways (312) and each open slot (321) has two opposite sides (3212) and an open bottom (3213) and may further have a guide rail (3214). The open bottom (3213) communicates with the open slot (3212). The guide rail (3214) is defined in one side (3214) of the open slot (321) and has a front wall (3215) protruding up from the guide rail (3214).

The terminals (41) correspond to and are mounted respectively through the through holes (311), correspond to and are mounted respectively through the positioning passageways (312) and correspond to and are mounted respectively in the open slots (321) of the insulative housing (30). Each terminal (41) may be formed from a straight cylindrical metal elements such as metal rod or wire by a bending process and has a circular cross section, a mounting section (413), a resilient section (411) and a contacting section (412).

The mounting section (413) is L-shaped, is mounted in the lateral segment (31) and has a vertical portion (4132) and a level portion (4131) and may further have a bulge (4133). The vertical portion (4132) is mounted through a corresponding through hole (311) of the lateral segment (31) of the insulative housing (30). The level portion (4131) is formed on and protrudes substantially perpendicularly from the vertical portion (4132), is mounted in a corresponding positioning passageway (312) and is blocked by the limiting block (313) over the corresponding positioning passageway (312). The bulge (4133) is formed on the vertical portion (4132) adjacent to the level portion (4131) and is located below and presses against the narrowed section (3115) of the corresponding through hole (311) to prevent the vertical portion (4132) from retracting into or falling out of the through hole (311).

The resilient section (411) is U-shaped, is formed on and protrudes substantially perpendicularly from the level portion (4131) of the mounting section (413), is mounted through the open bottom (3213) of a corresponding open slot (321) and is selectively compressed. The open bottom (3213) holds and prevents the resilient section (411) from inadvertently swaying.

The contacting section (412) is U-shaped, is formed on and protrudes substantially perpendicularly from the resilient section (411), is mounted in and extends forwards from the corresponding open slot (321), selectively contacts a contact of a battery (51*a*, 51*b*) and may have a distal end and a slide hook (4122). The slide hook (4122) is formed on and protrudes transversely from the distal end of the contacting section (412), is capable of sliding along the guide rail (3214) and selectively hooks on the front wall (3215) of the guide rail (3214). The front wall (3215) prevents the contacting section (412) from being inadvertently pulled out to lead to irreversible deformation. The length of the contacting section (412) may be modified according to a longer battery (51*a*) or a shorter battery (52*b*). When the battery (51*a*, 51*b*) is connected to the battery connector (100) and presses against the contacting sections (412) of the terminals (41), the resilient sections (411) are compressed and squeezed. The contacting sections (412) moves backward into the open slots (321) with the slide hooks (4122) sliding along the guide rails (3214). The guide rails (3214) guide and limit the moving paths of the slide hooks (4122) to prevent the contacting sections (412) from inadvertently slanting or irreversibly deforming.

The terminals (41) may be manufactured easily by a bending process, which increases the production rate and lowers the manufacturing cost of the battery connector (100). Furthermore, the terminals (41) are bent into small and compact structures. Therefore, the size of the battery connector (100) is efficiently reduced for pocket and portable electronic devices. Moreover, the limiting blocks (313) and guide rails (3214) prevents the terminals (41) from falling out of the insulative housing (30) or deforming so that the battery connector (100) is firm and durable.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A battery connector comprising:

an insulative housing having a lateral segment having a top;

a bottom;

a front end;

a rear end;

a row of through holes defined through the lateral segment;

a row of positioning passageways, the positioning passageways corresponding respectively to the through holes, defined through the lateral segment and communicating respectively with the through holes;

a row of limiting blocks, the limiting blocks corresponding respectively to the positioning passageways, formed on the top of the lateral segment and crossing respectively over the positioning passageways;

an upright segment formed on and protruding uprightly from the top of the lateral segment near the front end and having a row of open slots, the open slots defined through the upright segment, communicating respectively with the positioning passageways and each open slot having two opposite sides; and an open bottom communicating with the open slot; and a plurality of terminals mounted on the insulative housing, corresponding respectively to the through holes, positioning passageways and open slots and having a plurality of terminals, each terminal having a circular cross section;

a mounting section being L-shaped, mounted in the lateral segment of the insulative housing and having a vertical portion mounted through a corresponding through hole of the lateral segment of the insulative housing; and a level portion formed on and protruding substantially perpendicularly from the vertical portion, mounted in a corresponding positioning passageway and blocked by the limiting block over the corresponding positioning passageway;

a resilient section being U-shaped, formed on and protruding from the level portion of the mounting section, mounted through the open bottom of a corresponding open slot and selectively compressed; and a contacting section formed on and protruding from the resilient section, mounted in and extending forwards from the corresponding open slot.

2. The battery connector as claimed in claim 1, wherein each terminal is formed from a straight cylindrical element by a bending process.

3. The battery connector as claimed in claim 2, wherein each through hole of the insulative housing has a narrowed section;

the mounting section of each terminal further has a bulge formed on the vertical portion and located below and pressing against the narrowed section of a corresponding through hole.

4. The battery connector as claimed in claim 3, wherein:

each open slot of the insulative housing further has a guide rail defined in one side of the open slot; and the contacting section of each terminal has a distal end and a slide hook formed on and protruding transversely from the distal end, capable of sliding along the guiding rail.

5. The battery connector as claimed in claim 4, wherein:

the guide rail of each open slot has a front wall protruding up from the guide rail; and the slide hook of each terminal selectively hooking on the front wall of a corresponding open slot.

6. The battery connector as claimed in claim 3, wherein the resilient section of each terminal protrudes substantially perpendicularly from the level portion of the mounting section; and the contacting section of each terminal is U-shaped and protrudes substantially perpendicularly from the resilient section.

7. The battery connector as claimed in claim 4, wherein the resilient section of each terminal protrudes substantially perpendicularly from the level portion of the mounting section; and the contacting section of each terminal is U-shaped and protrudes substantially perpendicularly from the resilient section.

8. The battery connector as claimed in claim 5, wherein the resilient section of each terminal protrudes substantially perpendicularly from the level portion of the mounting section; and the contacting section of each terminal is U-shaped and protrudes substantially perpendicularly from the resilient section.

* * * * *